US009062858B2

(12) United States Patent
Yoo et al.

(10) Patent No.: US 9,062,858 B2
(45) Date of Patent: Jun. 23, 2015

(54) OPTICAL SEMICONDUCTOR LIGHTING APPARATUS

(71) Applicant: POSCO LED COMPANY LTD., Seongnam-si (KR)

(72) Inventors: Min Uk Yoo, Seongnam-si (KR); Jin Jong Kim, Seongnam-si (KR); Jung Hwa Kim, Seongnam-si (KR)

(73) Assignee: Posco LED Company Ltd., Seongnam-si (KR)

( * ) Notice: Subject to any disclaimer, the term of this patent is extended or adjusted under 35 U.S.C. 154(b) by 50 days.

(21) Appl. No.: 14/093,070

(22) Filed: Nov. 29, 2013

(65) Prior Publication Data

US 2015/0029733 A1 Jan. 29, 2015

(30) Foreign Application Priority Data

Jul. 23, 2013 (KR) ..... 10-2013-0086593
Jul. 23, 2013 (KR) ..... 10-2013-0086594

(51) Int. Cl.
*F21V 15/01* (2006.01)
*F21V 29/00* (2015.01)
*F21V 5/00* (2015.01)

(52) U.S. Cl.
CPC ..... *F21V 15/011* (2013.01); *F21V 29/004* (2013.01); *F21V 5/001* (2013.01); *F21V 29/20* (2013.01)

(58) Field of Classification Search
CPC ..... F21V 15/011; F21V 15/01; F21V 5/001; F21V 5/008; F21V 5/046; F21V 29/00; F21V 29/004; F21V 29/002; F21V 29/20; F21V 29/02; F21V 29/22; F21V 29/50; F21V 29/503; F21V 29/504; H01L 33/64; F21Y 2101/02
See application file for complete search history.

(56) References Cited

U.S. PATENT DOCUMENTS 8,388,197 B1 3/2013 Huang et al.
8,975,806 B2 * 3/2015 Kitagawa et al. ..... 313/110

(Continued)

FOREIGN PATENT DOCUMENTS

JP 2010-062005 3/2010
JP 2010-108774 5/2010

(Continued)

OTHER PUBLICATIONS

International Search Report dated on Apr. 9, 2014 in International Application No. PCT/KR2013/010722.

*Primary Examiner* — Bao Q Truong
(74) *Attorney, Agent, or Firm* — H.C. Park & Associates, PLC

(57) ABSTRACT

A optical semiconductor lighting apparatus includes: a board; a drive IC which is disposed in a central portion of the board; a plurality of semiconductor optical devices which is disposed adjacent to and around the drive IC in the board in a grid shape in one or more rows and columns; a non-insulating heat sink in which the board is disposed; an insulating housing which accommodates the heat sink and protects the drive IC and the plurality of semiconductor optical devices from withstand voltages; and a first optical member which faces the plurality of semiconductor optical devices, transmits or reflects light irradiated from the semiconductor optical devices, and forms a vertical vent hole corresponding to the drive IC; and a second optical member which is connected to an upper side of the housing and forms light distribution by refracting light transmitted or reflected from the first optical member.

10 Claims, 4 Drawing Sheets

(56) References Cited

U.S. PATENT DOCUMENTS

| | | | | |
|---|---|---|---|---|
| 2010/0026185 | A1 | 2/2010 | Betsuda et al. | |
| 2014/0293624 | A1* | 10/2014 | He | 362/373 |

FOREIGN PATENT DOCUMENTS

| | | |
|---|---|---|
| KR | 10-2010-0126009 | 12/2010 |
| KR | 20-0452816 | 3/2011 |

* cited by examiner

OPTICAL SEMICONDUCTOR LIGHTING APPARATUS

CROSS-REFERENCE(S) TO RELATED APPLICATION

This application claims the benefit of Korean Patent Application No. 10-2013-0086593, filed on Jul. 23, 2013, and Korean Patent Application No. 10-2013-0086594, filed on Jul. 23, 2013, in the Korean Intellectual Property Office, the contents of which are incorporated herein by reference in its entirety.

BACKGROUND OF THE INVENTION

1. Field of the Invention

The present invention relates to an optical semiconductor lighting apparatus, and more particularly, to an optical semiconductor lighting apparatus which can implement a compact apparatus while protecting circuit components and semiconductor optical devices in consideration of withstand voltages, can use semiconductor optical devices as a single lens by handling them as a single light source while utilizing a limited space and area, and can achieve uniform and efficient heat dissipation.

2. Description of the Related Art

As compared with incandescent bulbs and fluorescent lamps, optical semiconductors using a light source, such as a light emitting diode (LED), an organic LED, a laser diode, and an organic electroluminescent diode, have low power consumption, long lifespan, superior durability, and high luminance. Due to these advantages, the optical semiconductors have recently attracted attention as illumination component.

In a commercially-available lighting apparatus based on the above-described optical semiconductor, a housing equipped with a heat sink is connected to a socket base having the same shape as a halogen lamp or an incandescent bulb, an optical semiconductor as a light source is arrayed in the housing, and an optical member surrounding the optical semiconductor is mounted on the housing.

In a case where such a lighting apparatus is manufactured as a small bulb type lighting apparatus, called "candle light", it is necessary to consider a withstand voltage problem when arraying an optical semiconductor on a board, due to a characteristic of a heat sink made of an aluminum or an aluminum alloy.

However, a small bulb type lighting apparatus has difficulty in designing a layout of an optical semiconductor on a small board area, and confronts a problem that cannot fully exhibit heat dissipation performance due to the structural feature.

In addition, the small bulb type lighting apparatus has difficulty in efficiently arraying optical semiconductors on a narrow and limited board and confronts a problem that cannot fully exhibit heat dissipation performance due to the structural feature.

Therefore, there is an urgent need for developing an apparatus which can enable a stable layout design considering withstand voltages when circuit components and semiconductor optical devices are arranged in a limited space and area, and can efficiently exhibit heat dissipation performance.

SUMMARY OF THE INVENTION

The present invention has been made in an effort to solve the above problems, and is directed to provide an optical semiconductor lighting apparatus which can implement a compact apparatus while protecting circuit components and semiconductor optical devices in consideration of withstand voltages.

The present invention is directed to provide an optical semiconductor lighting apparatus which can achieve uniform and efficient heat dissipation.

In addition, the present invention is directed to provide an optical semiconductor lighting apparatus which can use a plurality of semiconductor optical devices as a single lens by handling them as a single light source while utilizing a limited space and area.

According to an aspect of the present invention, an optical semiconductor lighting apparatus includes: a board; a drive IC which is disposed in a central portion of the board; a plurality of semiconductor optical devices which is disposed adjacent to and around the drive IC in the board in a grid shape in one or more rows and columns; a non-insulating heat sink in which the board is disposed; and an insulating housing which accommodates the heat sink and protects the drive IC and the plurality of semiconductor optical devices from withstand voltages.

The optical semiconductor lighting apparatus may further include: a first optical member which is disposed on the board; and a second optical member which is connected to an upper side of the housing accommodating the heat sink, a lower edge of the second optical member fixing an edge of the first optical member, the second optical member being made of an insulator.

The first optical member may insulate the board from the heat sink.

The first optical member may form a vertical vent hole corresponding to the central portion of the board.

The first optical member may include: a main body which forms a vertical vent hole corresponding to the central portion of the board; and an insulating flange which extends from a lower edge of the main body and contacts an upper edge of the board.

A socket base may be connected to a lower end portion of the housing.

The heat sink may include: a metal cone which is tapered downwardly and has an opened bottom surface; a mounting groove which is formed by recessing a top surface of the cone and through which a line connected from the board passes; and a connection hole which is formed at an end portion of the mounting groove and communicates with an inside of the cone.

The heat sink may include: a metal cone which is tapered downwardly and has an opened bottom surface; and a mounting groove which is formed by recessing a top surface of the cone and through which a line connected from the board passes, and the plurality of semiconductor optical devices are disposed spaced apart from an upper edge of the cone.

The housing may include: a cone portion which has an opened top surface, forms an inner space to accommodate the heat sink, is tapered downwardly, and is made of a resin material; and a connection portion which extends from a lower portion of the cone portion and to which a socket base is connected.

The housing may further include a protrusion portion which is stepped at an upper edge of the cone portion and at which an upper edge of the heat sink is disposed.

The heat sink may further include a sleeve which is stepped at the upper edge of the cone portion tapered downwardly and is disposed at the protrusion portion.

According to another aspect of the present invention, an optical semiconductor lighting apparatus includes: a housing which accommodates a heat sink; a board which is disposed in the heat sink; a plurality of semiconductor optical devices which are disposed adjacent to and around a drive IC disposed in a central portion of the board; a first optical member which faces the plurality of semiconductor optical devices, transmits or reflects light irradiated from the semiconductor optical devices, and forms a vertical vent hole corresponding to the drive IC; and a second optical member which is connected to an upper side of the housing and forms light distribution by refracting light transmitted or reflected from the first optical member.

The first optical member may include: a main body in which the vent hole is formed; and an insulating flange which extends from a lower edge of the main body and contacts an upper edge of the board. Light irradiated from the plurality of semiconductor optical devices may be collected at an edge of the vent hole and be transmitted or reflected through a side and an upper end portion of the main body.

The first optical member may include a main body in which the vent hole is formed, the main body having a truncated conical shape tapered upwardly.

The vent hole may include: a vent portion which vertically passes through a central portion of the main body of the first optical member disposed above the board, and has an inverted truncated conical shape gradually widened upwardly from a bottom surface of the main body; and a reflection portion which has a funnel shape gradually widened from an upper end portion of the vent portion to an upper edge of the main body.

The first optical member may include: a main body in which the vent hole is formed; and a light collection portion which is formed on a bottom surface of the main body and is disposed corresponding to the plurality of semiconductor optical devices at an edge of the vent hole.

The light collection portion may protrude convexly toward the plurality of semiconductor optical devices.

The second optical member may be made to have a cross section of a semi-elliptical shape when cut in a minor axis direction with respect to a major axis, and a thickness of a lower edge of the semiconductor optical member may be thicker than a thickness of an upper end portion of the second optical member.

The optical semiconductor lighting apparatus may further include a ring protrusion which is stepped along a lower edge of the second optical member and fixes an upper edge of the housing while fixing a lower edge of the first optical member.

The heat sink may further include a mounting groove on which the board is disposed. A lower edge of the second optical member may cover an edge of the mounting groove. An upper edge of the board may be covered by the first optical member. The drive IC and the plurality of semiconductor optical devices may be insulated by the first and second optical members and be protected from withstand voltages.

The heat sink may be a non-insulator, and the housing and the first and second optical members ma be insulators.

In addition, the term "semiconductor optical device" as used in claims and detailed description refers to an LED chip or the like that includes or uses optical semiconductor.

The "semiconductor optical device" may include a package-level device with various types of optical semiconductor as well as the above-mentioned LED chip.

DETAILED DESCRIPTION OF EXEMPLARY EMBODIMENTS

Hereinafter, exemplary embodiments of the present invention will be described with reference to the accompanying drawings.

Figure 1:
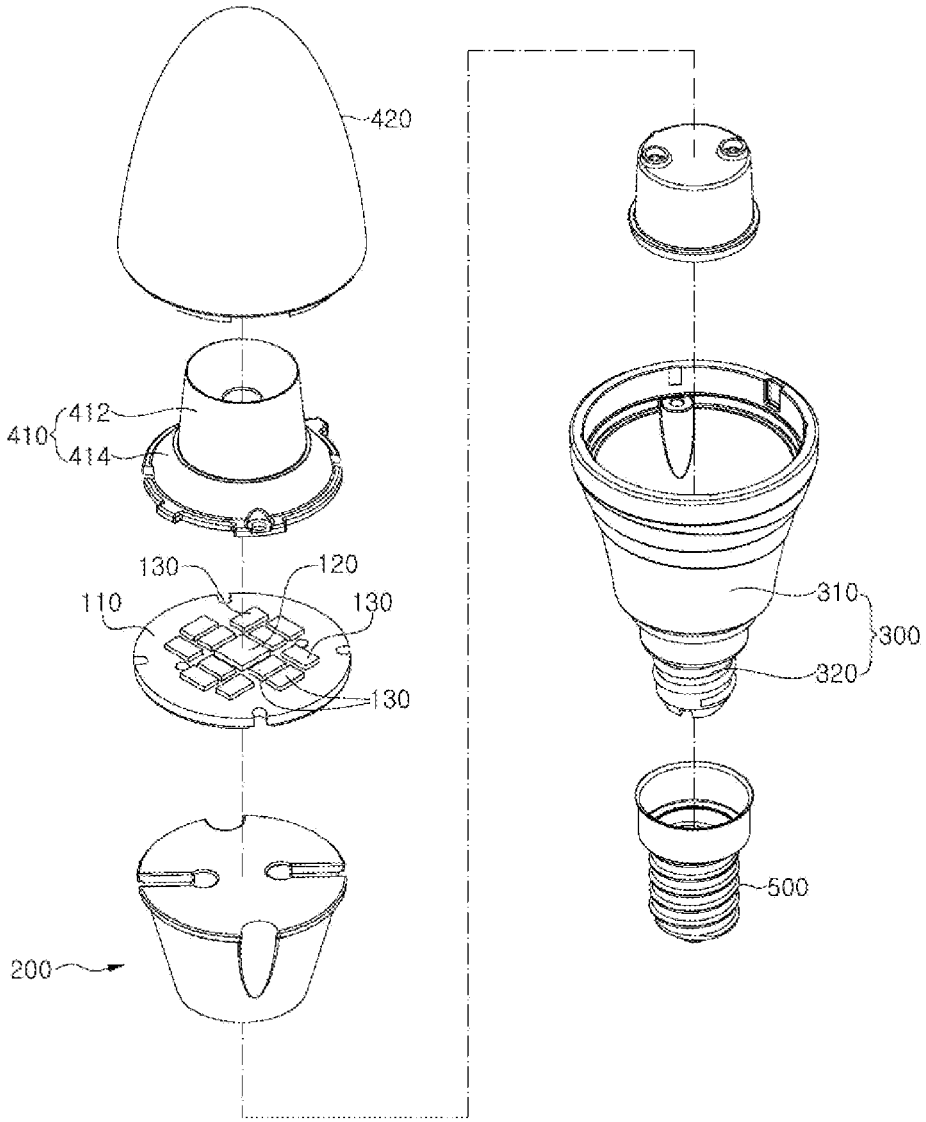
FIG. 1 is an exploded perspective view illustrating an overall configuration of an optical semiconductor lighting apparatus according to an embodiment of the present invention.
Figure 2:
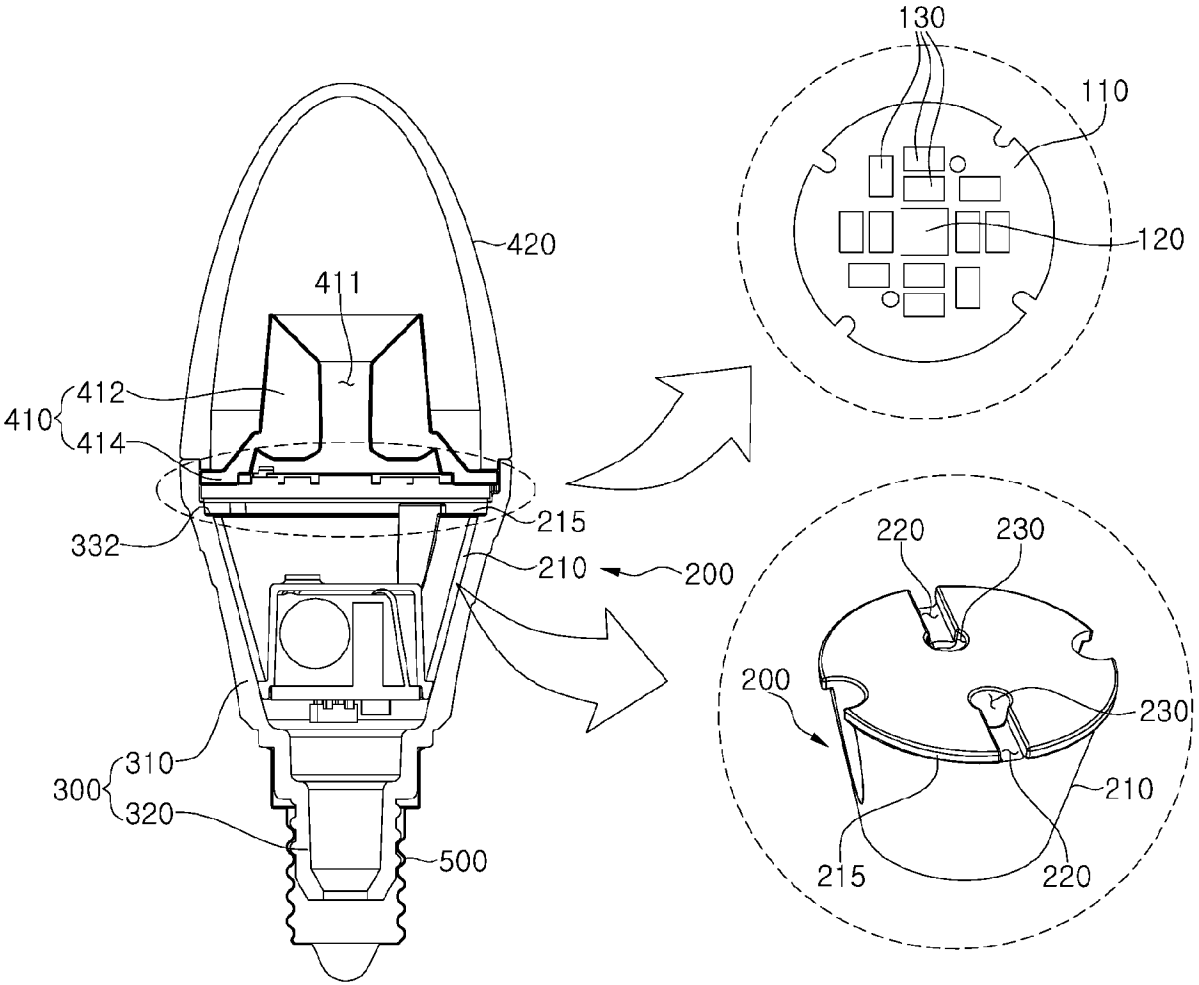
FIG. 2 is a cross-sectional conceptual diagram illustrating an overall configuration of an optical semiconductor lighting apparatus according to an embodiment of the present invention.

FIG. 1 is an exploded perspective view illustrating an overall configuration of an optical semiconductor lighting apparatus according to an embodiment of the present invention, and FIG. 2 is a cross-sectional conceptual view illustrating the overall configuration of the optical semiconductor lighting apparatus according to the embodiment of the present invention.

As illustrated in FIGS. 1 and 2, a drive IC 120 is disposed in a central portion of a board 110, and a plurality of semiconductor optical devices 130 are disposed adjacent to the drive IC 120 in the board 110.

A heat sink 200 is a non-insulator on a top surface of which the board 110 is disposed. The heat sink 200 is provided to implement heat dissipation performance. A housing 300 is an insulator which accommodates the non-insulating heat sink 200 and protects the drive IC 120 and the plurality of semiconductor optical devices 130 from withstand voltages.

In this case, it is preferable that the plurality of semiconductor optical devices 130 are provided in the board 110 in a grid shape in which they are disposed adjacent to and around the drive IC 120 in rows and columns.

Therefore, as illustrated, since the plurality of semiconductor optical devices 130 are densely disposed around the drive IC 120 in the board 110, that is, the plurality of semiconductor optical devices 130 are disposed spaced apart from an edge of the board 110 at regular intervals, it is possible to prevent failure and malfunction of the drive IC 120 and the semiconductor optical devices 130, which are caused by the withstand voltages, due to the structural feature of the general lighting apparatus in which a board is fixed by a non-insulator such as a bolt.

That is, unlike a typical insulation type SMPS, a small lighting apparatus, such as a so-called candle light, needs to be designed to protect the other components from the withstand voltages through a non-insulation type SMPS.

In other words, instead of a component occupying a volume and a weight, such as the above-mentioned SMPS, the drive IC 120 functions as the non-insulation type SMPS, and the non-insulation type drive IC 120 mechanically solves the withstand voltage problem.

Therefore, the withstand voltage problem can be solved from the structure designed such that the insulating housing 300 surrounds the non-insulating heat sink 200 in which the board 110 where the non-insulation type drive IC 120 is arrayed is disposed.

In addition to the above-described embodiment, the following various embodiments can also be applied to the present invention.

The heat sink 200, which is provided for implementing the heat dissipation performance as described above, is generally made of aluminum or an aluminum alloy with excellent heat dissipation performance.

The heat sink 200 is accommodated in the housing 300, and a socket base 500 is connected to a lower end portion of the heat sink 200.

More specifically, the heat sink 200 includes a cone 210, a mounting groove 220, and a connection hole 230. The cone 210 is tapered downwardly, has an opened bottom surface, and is made of a metal. The mounting groove 220 is formed by recessing a top surface of the cone 210, and a line (not illustrated) connected from the board 110 passes through the mounting groove 220. The connection hole 230 is formed at an end portion of the mounting groove 220 and communicates with the inside of the cone 210.

Since the plurality of semiconductor optical devices 130 are disposed spaced apart from the edge of the cone 210, the plurality of semiconductor optical devices 130 can be safely protected from the withstand voltages together with the drive IC 120.

In this case, it can be seen that the housing 300 largely includes a cone portion 310 and a connection portion 320.

The cone portion 310 has an opened top surface, forms an inner space to accommodate the heat sink 200 in which the board 110 is disposed, and is tapered downwardly. Due to the cone portion 310, the drive IC 120 and the semiconductor optical devices 130, which are disposed on the board 110 together with first and second optical members 410 and 420 to be described below, are protected from the withstand voltages.

The connection portion 320 extends from a lower portion of the cone portion 310 and is connected to the socket base 500. The connection portion 320 provides a space for electrically connecting the board 110 and the socket base 500.

It is preferable that the housing 300 further includes a protrusion portion 332 so as to provide convenience to a series of operations of exactly connecting and fixing the heat sink 200.

The protrusion portion 332 is formed at an upper edge of the cone portion 310, and an upper edge of the heat sink 200 is disposed in the protrusion portion 332.

In this case, it is preferable that the heat sink 200 further includes a sleeve 215 which is stepped at an upper edge of the downwardly-tapered cone 210 and is disposed in the protrusion portion 332.

In addition, the optical semiconductor lighting apparatus according to the embodiment of the present invention further includes first and second optical devices 410 and 420 so as to perform the light distribution proper to the lighting apparatus and completely insulate the board 110 from the non-insulator such as the heat sink 200.

The second optical member 420 being an insulator is connected to an upper portion of the housing 300, and the first optical member 410 being an insulator is fixed to an upper edge of the board 110 by a lower end edge of the second optical member 420 and insulates the board 110 from the heat sink 200.

The first optical member 410 includes a main body 412 which forms a vertical vent hole 411 corresponding to a central portion of the board 110 functioning as a heat dissipation path so as to implement smooth heat dissipation performance.

It is apparent that the first optical member 410 further includes an insulating flange 414 which extends from a lower edge of the main body 412 and comes into contact with the upper edge of the board 110, such that the first optical member 410 is fixed by the lower end edge of the second optical member 420.

Figure 3:
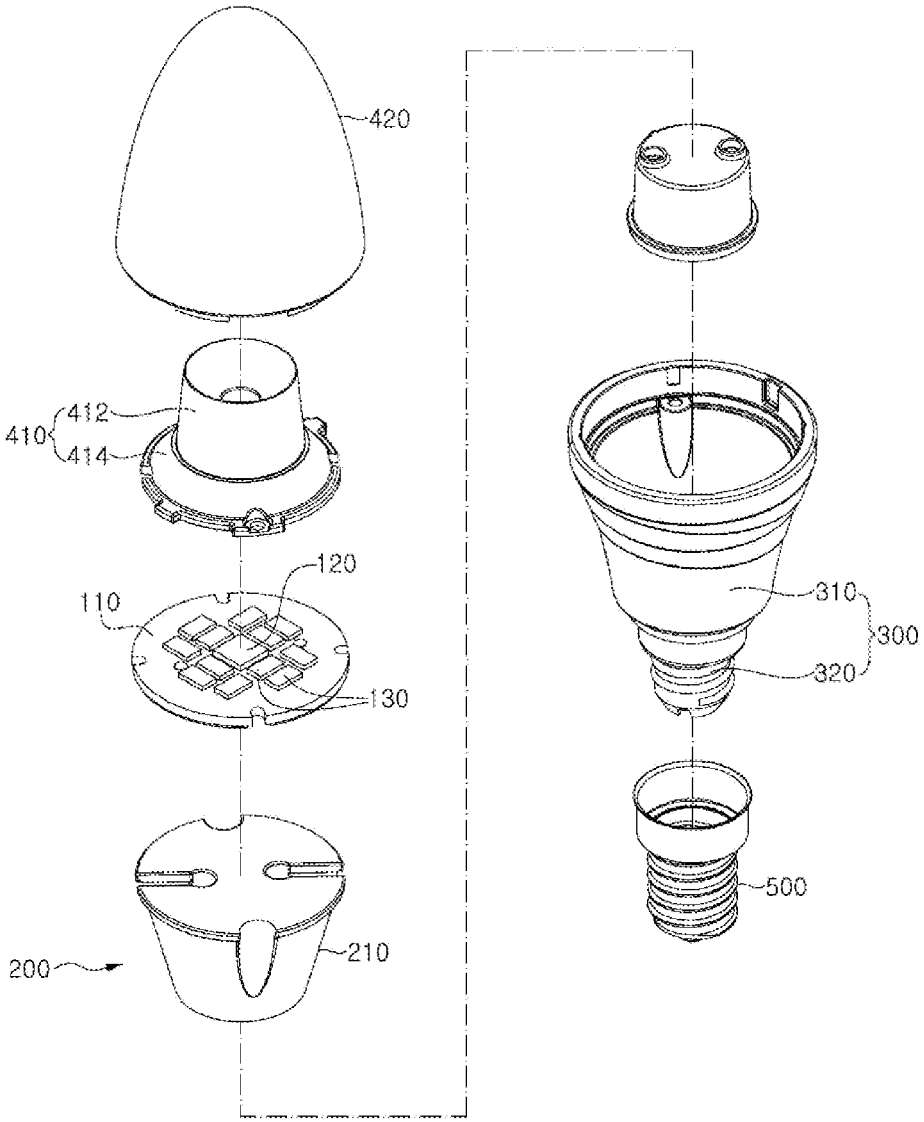
FIG. 3 is an exploded perspective view illustrating an overall configuration of an optical semiconductor lighting apparatus according to another embodiment of the present invention.
Figure 4:
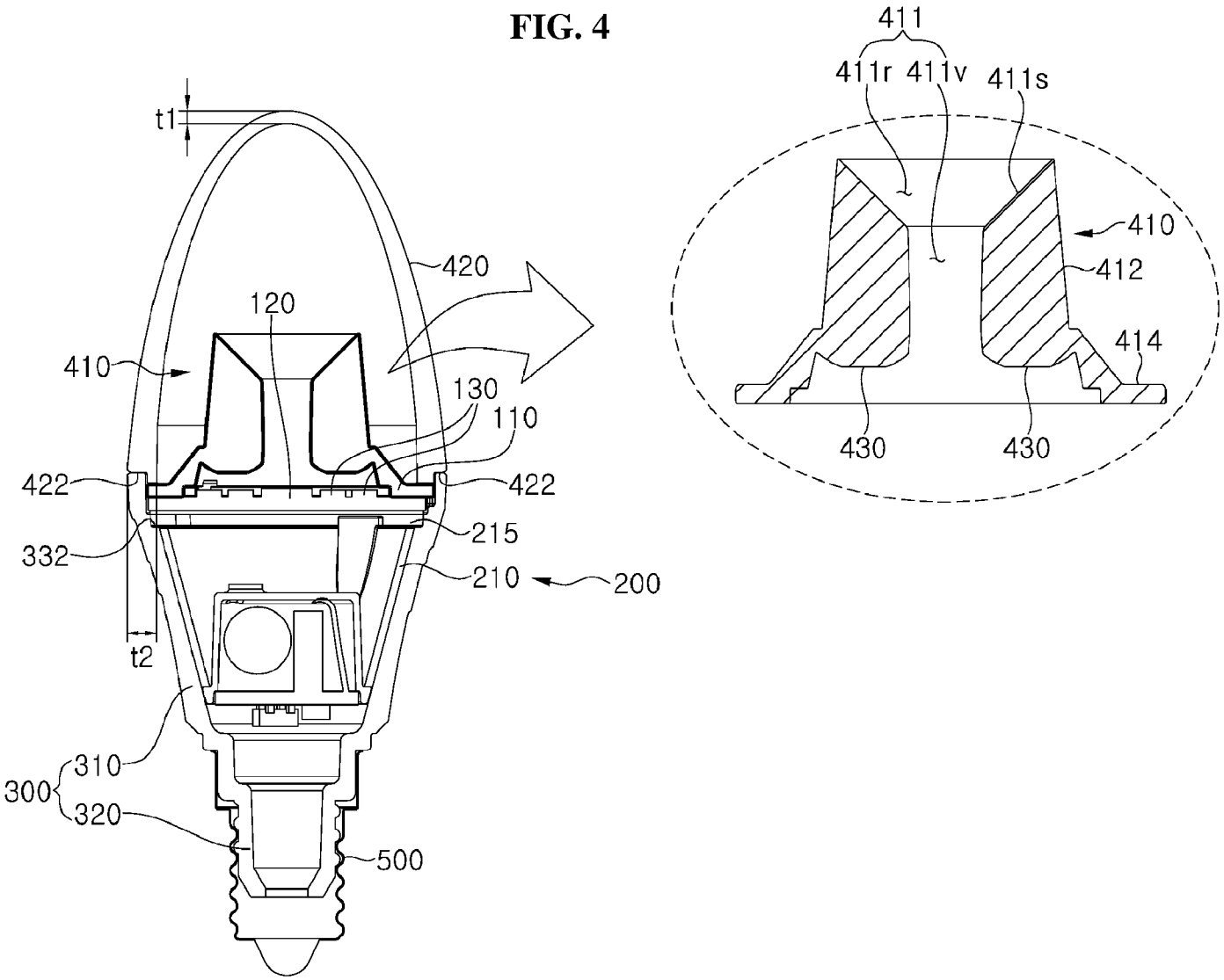
FIG. 4 is a cross-sectional conceptual diagram illustrating an overall configuration of another optical semiconductor lighting apparatus according to an embodiment of the present invention.

In addition to the above-described embodiment, embodiments illustrated in FIGS. 3 and 4 can also be applied to the present invention.

For reference, in FIGS. 3 and 4, the same reference numerals as used in FIGS. 1 and 2 are assigned to the same elements as those of FIGS. 1 and 2.

FIG. 3 is a cross-sectional conceptual diagram illustrating an overall configuration of an optical semiconductor lighting apparatus according to another embodiment of the present invention.

As illustrated in FIG. 3, the optical semiconductor lighting apparatus includes a board 110, a heat sink 200, a housing 300, and first and second optical members 410 and 420.

A drive IC 120 is disposed in a central portion of the board 110, and a plurality of semiconductor optical devices 130 are disposed around and adjacent to the drive IC 120. The board 110 makes it possible to design the maximally effective arrangement with respect to a limited and narrow space and area in a small lighting apparatus such as a so-called candle light and to design a structure to protect the drive IC 120 and the semiconductor optical devices 130 from the withstand voltages.

The heat sink 200, in which the board 110 is disposed, is provided for solving a problem of heat generation from the drive IC 120 and the semiconductor optical devices 130.

The housing 300 accommodates the heat sink 200 and also provides a mounting space for the first optical member 410 to be described below.

The first optical member 410 is fixed to the upper edge of the board 110 by the lower end edge of the second optical member 420, and forms a vertical vent hole 411 corresponding to the drive IC 120. The first optical member 410 is also used to implement heat dissipation performance by inducing uniform and efficient heat dissipation through the vent hole 411 while performing the function proper to the optical member together with the second optical member 420.

The second optical member 420 is connected to the upper side of the housing 300 and functions to change a light distribution area through optical diffusion or scattering and protect the drive IC 120 and the semiconductor optical devices 130 from external shock.

Therefore, the first optical member 410 primarily controls light distribution, and the second optical member 420 secondarily controls light distribution, making it possible to operate the lighting apparatus having a light distribution area at more various light distribution angles.

More specifically, the first optical member 410 faces the plurality of semiconductor optical devices 130 and performs primary a light distribution control. For example, the first optical member 410 collects light irradiated from the plurality of optical devices 130 and transmits or reflects the collected light.

In addition, the second optical member 420 performs a secondary light distribution control that forms various light distributions by refracting light transmitted or reflected from the first optical member 410 in an unspecific direction.

In addition to the above-described embodiment, the following various embodiments can also be applied to the present invention.

The plurality of semiconductor optical devices 130 function as a light source. More specifically, it is advantageous in terms of layout design to arrange the plurality of semiconductor optical devices 130 radially around the drive IC 120.

On the other hand, the heat sink 200, which performs the heat dissipation function as described above, is generally made of a metal which is a non-insulator with excellent heat dissipation performance, for example, aluminum or an aluminum alloy.

It is advantageous that the housing 300 and the first and second optical members 410 and 420 are made of an insulator with respect to the non-insulating heat sink 200 so as to protect the drive IC 120 and the semiconductor optical devices 130 from the withstand voltages.

The heat sink 200 is accommodated in the housing 300, and a socket base 500 is connected to a lower end portion of the heat sink 200.

More specifically, the heat sink 200 includes a cone 210 which is tapered downwardly and is made of a metal, and the board 110 is disposed on the cone 210.

On the other hand, specifically, the housing 300 accommodates the non-insulating heat sink 200 in which the board 110 is disposed, and largely includes a cone portion 310 and a connection portion 320.

The cone portion 310 has an opened top surface, forms an inner space to accommodate the heat sink 200 in which the board 110 is disposed, and is tapered downwardly. The cone portion 310 provides a space for mounting the first and second optical members 410 and 420 to be described below.

The connection portion 320 extends from a lower portion of the cone portion 310 and is connected to the socket base 500. The connection portion 320 provides a space for electrically connecting the board 110 and the socket base 500.

It is preferable that the housing 300 further includes a protrusion portion 332 so as to provide convenience to a series of operations of exactly connecting and fixing the heat sink 200.

The protrusion portion 332 is formed at an upper edge of the cone portion 310 in a step shape, and an upper edge of the heat sink 200 is disposed in the protrusion portion 332.

In this case, it is preferable that the heat sink 200 further includes a sleeve 215 which is stepped at an upper edge of the downwardly-tapered cone 210 and is disposed in the protrusion portion 332.

Since the upper edge of the board 110 is covered by the lower edge of the first optical member 410, and the lower edge of the second optical member 420 to be described below covers the lower edge of the first optical member 410, the drive IC 120 and the plurality of semiconductor optical devices 130 are insulated by the first and second optical members 410 and 420, and thus, can be protected from the withstand voltages.

The second optical member 420 is connected to the upper side of the housing 300 as described above. In order to implement a feeling of a so-called candle light, the second optical member 420 may be made to have a cross section of a semi-elliptical shape when cut in a minor axis direction with respect to a major axis.

Therefore, the second optical member 420 may give a feeling of a candle frame brazing in the upper side of the housing 300 as a whole.

In addition, it is preferable that a thickness t2 of the lower end edge of the second optical member 420 is thicker than a thickness t1 of the upper end portion of the second optical member 420 so as to implement various light distributions, for example, backward light distribution.

That is, the configuration that the thickness of the second optical member 420 is gradually increased from the upper end portion to the lower end portion basically aims to achieve a structural stability and also provides a wide variety of irradiation directions of light transmitted while being refracted through the transparent or translucent second optical member 420.

In other words, as the thickness of the second optical member 420 is gradually increased from the upper end portion to the lower end portion, the refractive index of the second optical member 420 is also increased in proportion thereto. Therefore, the structural feature of the second optical member 420 is technical means that can implement light distribution in various directions by irradiating light transmitted or reflected from the first optical member 410 at more greatly tilted angle, and can also completely implement backward light distribution.

More specifically, since the refractive index is also large at a position near to the lower edge of the second optical member 420, the light transmitted or reflected from the first optical member 410 is transmitted after being again titled at a large angle as much. Therefore, the backward light distribution can be efficiently formed.

In addition, the optical semiconductor lighting apparatus according to the embodiment of the present invention may include a ring protrusion 422 for mutually connecting and fixing the second optical member 420 and the cone portion 310 of the housing 300 and fixing the first optical member 410 to be described below.

That is, the ring protrusion 422 is stepped along the lower edge of the second optical member 420, and fixes the lower edge of the first optical member 410.

On the other hand, the first optical member 410 also performs heat dissipation performance as well as the function proper to the optical member as described above, and includes a main body 412 and an insulating flange 414.

The main body 412 includes a vent hole 411 passing through a central portion thereof in a vertical direction, and the vent hole 411 is disposed corresponding to the central portion of the board 110 on which the drive IC 120 is disposed.

The insulating flange 414 extends from the lower edge of the main body 412, contacts the upper edge of the board 110, and is locked and fixed to the ring protrusion 422 formed along the lower edge of the second optical member 420.

The shape of the main body 412 will be described below in more detail. As illustrated, the main body 412 has a truncated conical shape that is tapered upwardly. The inclined outer surface of the main body 412 can adjust the light distribution angle by replacing a part having a changed inclined angle appropriately with respect to the insulating flange 414 and mounting it on the board 110.

The structure of the vent hole 411 will be described below in more detail. As illustrated in FIG. 4, the vent hole 411 includes a vent portion **411*v* and a reflection portion 411*r***.

The vent portion **411*v* vertically passes through the central portion of the main body 412 of the first optical member 410 disposed above the board 110, and has an inverted truncated conical shape that is widened from the bottom surface to the upper portion of the main body 412**.

Forming the vent portion **411*v*** in the inverted truncated conical shape that is gradually widened upwardly is considered as a design for inducing an efficient rise of heat that dissipates because its volume is expanded as it goes upward.

The reflection portion **411*r* has a funnel shape that is gradually widened from the upper end portion of the vent portion 411*v* to the top edge of the main body 412. Specifically, the reflection may be considered as technical means that is provided by a slope surface 411*s* formed above the main body 412 and inclined downwardly toward the center of the main body 412, so as to irradiate light from the semiconductor optical devices 130** over a wider area.

Since the light irradiated from the plurality of semiconductor optical devices 130 is tilted and reflected from the slope surface 411*s* at various angles, it is possible to adjust the backward light distribution and the light distribution of various directions together with the second optical member 420.

In addition, it is preferable that the first optical member 410 includes a light collection portion 430 formed on a bottom surface of the main body 412 and disposed in a ring shape corresponding to the plurality of semiconductor optical devices 130 at the edge of the vent hole 411.

It can be seen that the light collection portion 430 is technical means which can allow the main body 412 to function as a single lens by handling the plurality of semiconductor optical devices 130 disposed on the board 110 as a single light source.

Specifically, the light collection portion 430 protrudes in a ring shape convex toward the plurality of semiconductor optical devices 130, and the cross section thereof protrudes in a shape in which circular arcs are connected on both ends of a substantially straight line.

Therefore, the light irradiated from the plurality of semiconductor optical devices 130 is collected at the light collection portion 430, and a part of the light is transmitted through the outer surface of the main body 412 or is reflected from the slope surface 411*s* of the main body 412 through the reflection portion 411*r* in various directions.

Thereafter, due to the structural feature that the second optical member 420 is gradually thickened from the upper end portion to the lower end portion, the light transmitted or reflected from the first optical member 410 in various directions is reflected or transmitted by the differently changing refractive indexes, making it possible to adjust the light distribution in various directions, as well as the backward light distribution.

As described above, the basic technical spirit of the present invention is to provide the optical semiconductor lighting apparatus which can implement the compact apparatus while protecting the circuit components and the semiconductor optical devices in consideration of the withstand voltage, can use the plurality of semiconductor optical devices as a single lens by handling them as a single light source while using the limited space and area, and can achieve the uniform and efficient heat dissipation.

The above-described configurations according to the present invention can obtain the following effects.

First, it is possible to prevent damage and malfunction of various circuit components, in consideration of withstand voltages, in such a manner that the drive IC is disposed in the central portion of the board and the plurality of semiconductor optical devices are disposed around the drive IC and spaced apart from the edge of the board by more than a predetermined distance.

In particular, layout and fixing design considering withstand voltages can be achieved by completely insulating the board from components, such as the non-insulating heat sink on which the board is mounted, in such a manner that the upper edge of the board surrounds the first optical member, and the edge of the first optical member is fixed to the edge of the second optical member, and the second optical member is connected to the insulating housing.

The present invention can implement heat dissipation performance through uniform and efficient heat dissipation by the first optical member including the vertical vent hole around the drive IC.

In addition, the plurality of light sources can be handled as a single light source and be coped with a single lens in such a manner that the plurality of semiconductor optical devices are disposed around the drive IC in the central portion of the board having a limited and small area, and the second optical member is provided to cover the upper edge of the board and function as a lens corresponding to the plurality of semiconductor optical devices. Therefore, it is possible to reduce fabrication and design costs and implement efficient light distribution.

While the embodiments of the present invention have been described with reference to the specific embodiments, it will be apparent to those skilled in the art that various changes and modifications may be made without departing from the spirit and scope of the invention as defined in the following claims.

What is claimed is:

1. An optical semiconductor lighting apparatus comprising:

a housing which accommodates a heat sink;

a board which is disposed in the heat sink;

a plurality of semiconductor optical devices which are disposed adjacent to and around a drive IC disposed in a central portion of the board;

a first optical member which faces the plurality of semiconductor optical devices, transmits or reflects light irradiated from the semiconductor optical devices, and forms a vertical vent hole corresponding to the drive IC; and a second optical member which is connected to an upper side of the housing and forms light distribution by refracting light transmitted or reflected from the first optical member.

2. The optical semiconductor lighting apparatus of claim 1, wherein the first optical member comprises:

a main body in which the vent hole is formed; and an insulating flange which extends from a lower edge of the main body and contacts an upper edge of the board, and light irradiated from the plurality of semiconductor optical devices is collected at an edge of the vent hole and is transmitted or reflected through a side and an upper end portion of the main body.

3. The optical semiconductor lighting apparatus of claim 1, wherein the first optical member comprises a main body in which the vent hole is formed, the main body having a truncated conical shape tapered upwardly.

4. The optical semiconductor lighting apparatus of claim 1, wherein the vent hole comprises:

a vent portion which vertically passes through a central portion of the main body of the first optical member disposed above the board, and has an inverted truncated conical shape gradually widened upwardly from a bottom surface of the main body; and a reflection portion which has a funnel shape gradually widened from an upper end portion of the vent portion to an upper edge of the main body.

5. The optical semiconductor lighting apparatus of claim 1, wherein the first optical member comprises:

a main body in which the vent hole is formed; and a light collection portion which is formed on a bottom surface of the main body and is disposed corresponding to the plurality of semiconductor optical devices at an edge of the vent hole.

6. The optical semiconductor lighting apparatus of claim 5, wherein the light collection portion protrudes convexly toward the plurality of semiconductor optical devices.

7. The optical semiconductor lighting apparatus of claim 1, wherein the second optical member is made to have a cross section of a semi-elliptical shape when cut in a minor axis direction with respect to a major axis, and a thickness of a lower edge of the semiconductor optical member is thicker than a thickness of an upper end portion of the second optical member.

8. The optical semiconductor lighting apparatus of claim 1, further comprising a ring protrusion which is stepped along a lower edge of the second optical member and fixes an upper edge of the housing while fixing a lower edge of the first optical member.

9. The optical semiconductor lighting apparatus of claim 1, wherein the heat sink further comprises a mounting groove on which the board is disposed, a lower edge of the second optical member covers an edge of the mounting groove, an upper edge of the board is covered by the first optical member, and the drive IC and the plurality of semiconductor optical devices are insulated by the first and second optical members and are protected from withstand voltages.

10. The optical semiconductor lighting apparatus of claim 1, wherein the heat sink is a non-insulator, and the housing and the first and second optical members are insulators.

* * * * *